United States Patent [19]

Zollweg et al.

[11] 4,178,788

[45] Dec. 18, 1979

[54] ADJUSTABLE CLAMP DIE

[75] Inventors: Richard T. Zollweg, Garden Grove; Homer L. Eaton, Leucadia, both of Calif.

[73] Assignee: Eaton-Leonard Corporation, Carlsbad, Calif.

[21] Appl. No.: 889,863

[22] Filed: Mar. 24, 1978

[51] Int. Cl.[2] ..... B21D 7/04

[52] U.S. Cl. ..... 72/154; 72/155; 72/159

[58] Field of Search ..... 72/149, 154, 155, 156, 72/157, 158, 159, 310, 311, 318, 321, 319, 322

[56] References Cited

U.S. PATENT DOCUMENTS

| | | | |
|---|---|---|---|
| 1,167,538 | 1/1916 | True | 72/159 |
| 1,261,229 | 4/1918 | Hansen | 72/158 X |
| 2,974,706 | 3/1961 | DeWitt | 72/154 |
| 3,118,488 | 1/1964 | Barnhill | 72/319 |
| 4,063,441 | 12/1977 | Eaton | 72/151 |
| 4,078,411 | 3/1978 | Eaton | 72/154 |

FOREIGN PATENT DOCUMENTS 1274621 9/1960 France .

*Primary Examiner*—E. M. Combs
*Attorney, Agent, or Firm*—Gausewitz, Carr & Rothenberg

[57] ABSTRACT

In a rotary pipe bending machine in which the pipe is clamped against a rotary bend die by a clamp die and the two dies are rotated together while a rear section of the pipe is pressed by a pressure die, the clamp die is adjustably mounted for motion tangentially of the bend die. The clamp die can be driven between a first position in which it is spaced forwardly of the bend die axis and forwardly of the bend die, and a second position in which it is positioned substantially at a point of tangency between the pipe to be bent and the bend die. The position of the clamp die is chosen according to the length of the straight portion of the pipe between a previous bend and the point at which the next bend is to be made.

5 Claims, 5 Drawing Figures

ADJUSTABLE CLAMP DIE

BACKGROUND OF THE INVENTION

The present invention relates to apparatus for bending tubes and more particularly concerns an improved die assembly for such apparatus.

In rotary bending apparatus the forward section of a tube is clamped to a rotary bend die by a clamp die and a rearward section of the tube is pressed against the bend die, or some other backup element, by a pressure die. The bend and clamp dies are rotated together with the tube clamped therebetween to wrap the tube around the bend die. In rotary draw bending the tube is stretched beyond its yield point as it is bent. A restraint is placed upon a rear section of the tube, as by the pressure die for example, and at the same time the clamp die presses a forward portion of the tube against the bend die with a force sufficient to insure stretching the outer or convex side of the pipe bend beyond yield.

To achieve adequate pressure on the tube between the clamp and bend die for draw bending, it has been common to press the tube over a significant length of the tube. Commonly the clamp die has a length parallel to the extent of the tube in the order of two to three times the tube diameter. If the clamp die is much shorter than this, the tube is likely to slip relative to the clamp die, or in the alternative, such great force must be exerted by the clamp upon the tube that the tube may be unacceptably deformed. Since it is impossible to make two successive bends in a tube that are significantly closer together than the length of the clamp die, the required use of a long clamp die prevents bending a pipe so as to have short straight pipe sections.

As shown in co-pending applications of Homer L. Eaton for Method and Apparatus for Bending Tube, Ser. No. 614,946, filed Sept. 19, 1975, now abandoned Ser. No. 692,585, filed June 3, 1976, U.S. Pat. No. 4,063,441 and Ser. No. 825,554, filed Aug. 18, 1977, U.S. Pat. No. 4,130,004 all of which are assigned to the assignee of the present invention, a shorter clamp die may be employed in draw bending if a bend is initiated as a compression bend (e.g., without initially stretching the pipe beyond its yield) and after the bend and clamp dies have rotated approximately twenty degrees for example, further restraint is placed on the tube to effect a stretching beyond its yield point. In such an arrangement a short clamp die may be employed to provide sufficient clamping force without unacceptably deforming the tube. Further, in pure compression bending, a shorter length of clamp die may be employed since clamping forces great enough for tube stretching are not required.

Consequently, when using a shorter clamp die, the clamp die may be positioned forwardly of the bend die along the length of the pipe to be bent so that it will exert a force against the pipe directed along a line that is spaced from the axis of rotation of the bend die. This provides a greater moment arm for the clamping force and results in less deformation of the pipe by the clamp die. Where the longer clamp dies have been used on the other hand, it has been the custom to position the clamp die as far rearwardly as possible so that the rear end of the clamp die is substantially at the point of tangency between the pipe and the bend die. This was necessary with a long clamp die so that, where required in a pipe with multiple bends, successive bends could be made as close together as possible. However, even with a long clamp die, improved rotary bending and in particular less deformation of the pipe, will occur and less force need be exerted by the clamp die, if the clamp die can be moved forwardly in the plane of bend to space the point of application of clamp die force from the bend die axis.

Although it is desirable to perform a bending operation with a more forwardly positioned clamp die, it is not possible, as previously mentioned, to employ this clamp die position when a bend is to be made so close to a previously made bend that the straight portion of pipe between the two successive bends is not significantly greater than the length of the clamp die. For this reason in the past, the clamp die has been positioned substantially at the point of tangency of the pipe and the bend die despite the fact that for many bends this is not an optimum position.

Accordingly it is an object of the present invention to avoid or minimize above-mentioned problems and to improve clamp die operation.

SUMMARY OF THE INVENTION

In carrying out principles of the present invention in accordance with a preferred embodiment thereof, there is provided a bend die mounted on a support for rotation about a bend axis and first and second auxiliary dies are movably mounted on the support to press forward and rearward sections of a member to be bent toward the bend die. One of the auxiliary dies is shiftable tangentially of the bend die so that it may operate at different distances from the bend axis. According to a feature of the invention, this shiftable auxiliary die is alternatively positioned either at a point tangent to the bend die or at a second point spaced from the bend die along a line tangent to the bend die. In a specific mechanization the clamp die, having a pipe receiving cavity formed therein and extending along a cavity axis, is mounted upon a slide which in turn is mounted in a slide holder for motion parallel to the cavity axis. The slide holder is adapted to be mounted for motion along an axis transverse to the cavity axis so as to move the clamp to and from clamping position. Means are provided for driving the slide along the cavity axis to shift the die relative to the slide holder.

DETAILED DESCRIPTION

Figure 1:
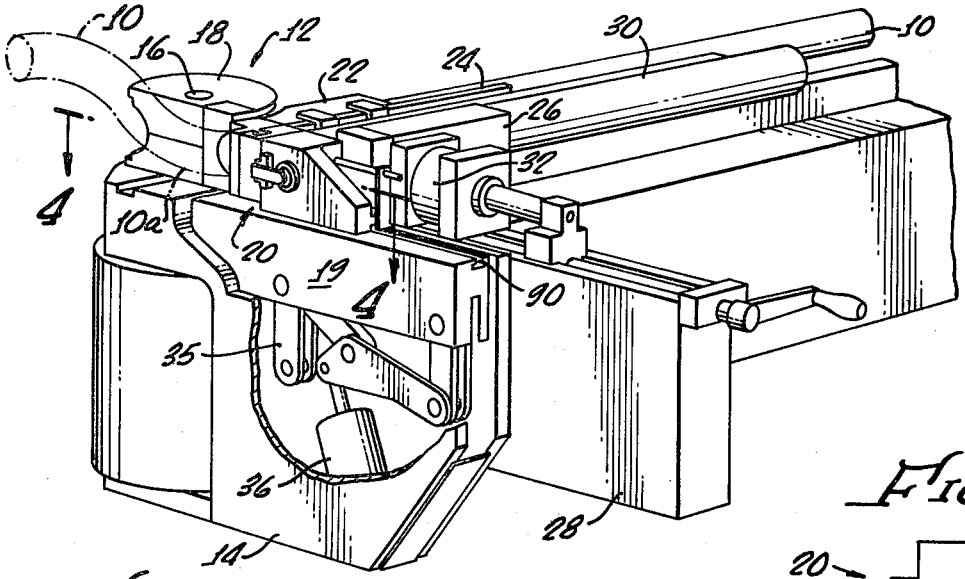
FIG. 1 is a pictorial illustration of a rotary bending machine embodying an adjustable die constructed in accordance with principles of the present invention.

Illustrated in FIG. 1 is a rotary bending machine of the type illustrated in further detail in the above-mentioned co-pending applications of Homer L. Eaton, the disclosures of which are hereby fully incorporated by this reference. In the machine of FIG. 1, a pipe 10 that is to be bent is grasped in a carriage-mounted chuck (not shown) for longitudinal and rotational positioning with respect to the machine bending head 12. The bending head 12 includes a swinging bend arm assembly having a swinging arm structure 14 mounted for pivotal motion about the axis of a vertical bend shaft 16 and carrying a fixed but removable partly circular bend die 18. Movably mounted upon the bend arm structure 14 for motion radially of the bend die, to and from the bend die, is a bend arm slide 19 which carries a clamp die assembly generally indicated at 20. A pressure die 22 is detachably mounted on a pressure die slide 24 which itself is slidably mounted in a pressure die bolster 26 for travel forwardly and rearwardly of the bending head. Bolster 26 is mounted to a stationary arm structure 28 for motion substantially radially of the bend die. An hydraulic booster cylinder 30 is provided to drive the pressure die slide forwardly and an hydraulic pressure die cylinder 32 drives the bolster together with the pressure die slide and pressure die radially of the bend die to press the pipe 10 against the bend die. The bend arm slide 19 is driven radially toward and away from the bend die by means of a parallel linkage 35 and an hydraulic clamp die cylinder 36 mounted to the bend arm structure 14. Further details of the structure of the bending machine are described in the above-identified patent applications.

In operation of the described bending machine a pipe to be bent is grasped in the chuck which is mounted on the carriage, the carriage is advanced until a point of tube 10 at which a bend is to be made is properly positioned with respect to the bend die. The chuck is rotated until the tube is rotationally positioned to obtain a proper plane of bend, it being understood that with the vertical bend axis illustrated the machine will bend the pipe in a horizontal plane. With the pipe properly positioned with respect to the bend die, clamp die cylinder 36 and bolster cylinder 32 are actuated to drive the clamp and pressure dies radially toward the bend die, in a direction perpendicular to a tangent to the bend die at the point of contact thereof with the pipe 10. A forward portion of the pipe is clamped against the bend die by the clamp die and a rearward portion is clamped against the bend die (or some other backup member, not shown). Then an hydraulic bend drive cylinder (not shown) is actuated to rotate the entire swinging bend arm assembly about the bend axis 16. The forward section of the pipe, which is clamped between the clamp and bend dies, is bent around the bend die as the bend and clamp dies rotate and is drawn past the opposing pressure and bend dies to achieve the desired bend.

The clamp die is shown in FIG. 1 in a tangentially retracted position which is employed to make a bend in a tube closely adjacent the immediately previous bend that has been made in the tube. Thus looking down upon the plane of bend in the horizontal section illustrated in FIG. 4, the rearward edge 40 of clamp die 42 is positioned substantially on or adjacent the point of tangency between the axis of the pipe 10 and the bend die. This point of tangency is the point at which the bend will commence. The pressure die 22, when driven against the pipe, has a forward edge closely adjacent and slightly to the rear of the rear edge 40 of the clamp die and thus is also positioned substantially at the point of tangency.

Each of the dies is formed with a cavity capable of receiving a portion of the pipe to be bent and these cavities cooperate to firmly grasp and press against the pipe. The axes of the cavities are aligned with the pipe axis and the pipe is pressed into these cavities during the bending operation.

Figure 2:
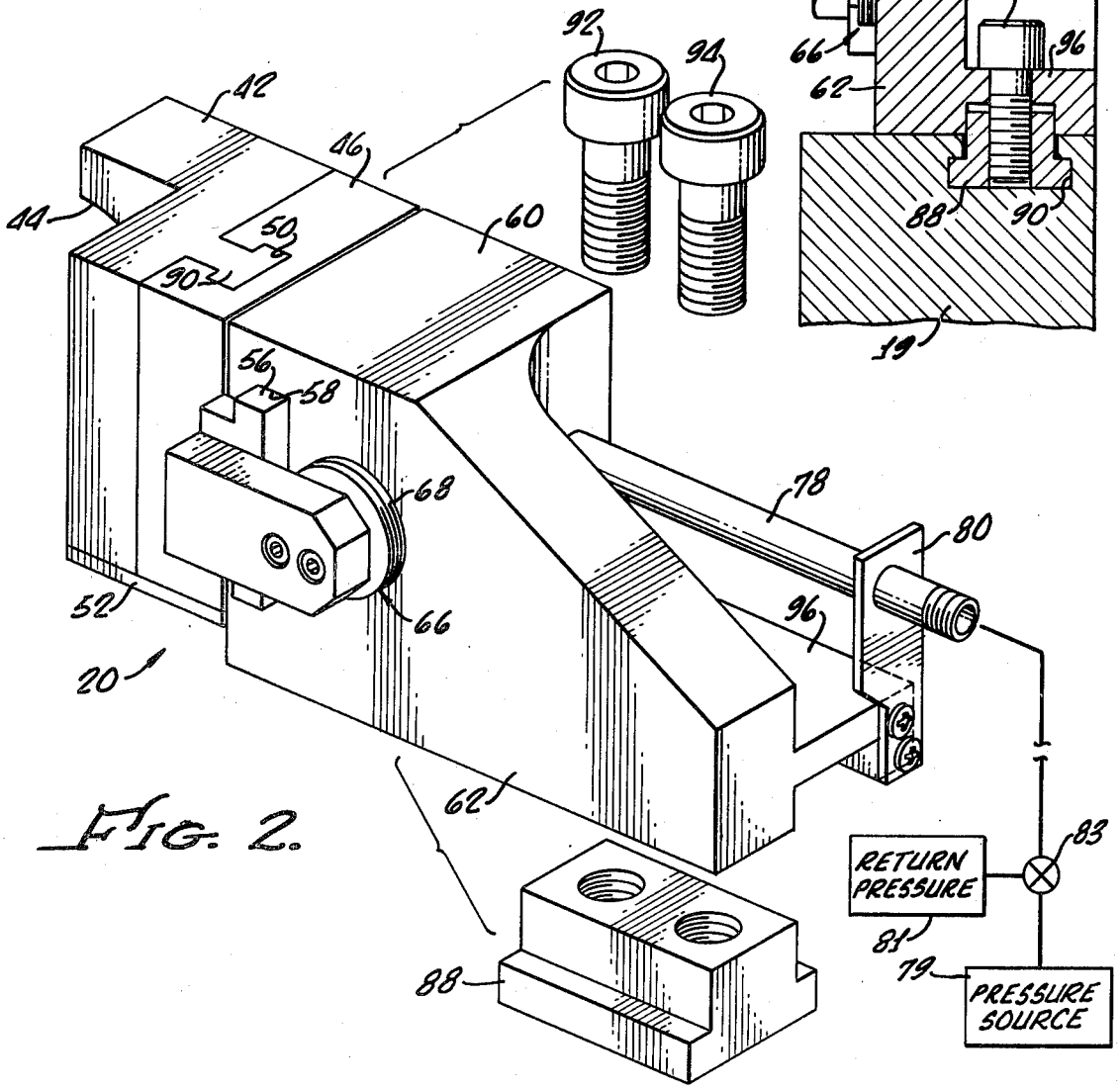
FIG. 2 is a partly exploded perspective view of the adjustable die assembly.

As can be seen in FIGS. 1 and 2, clamp die 42 is formed with a pipe receiving cavity 44 and is detachably mounted upon a slide plate 46 by means of a vertically extending T-shaped guide 48 fixed to the die and slidably received within a complimentary vertically extending T-shaped slot 50 formed in the slide plate 46. The die 42 rests upon a horizontally extending shelf member 52 fixed to the bottom of slide plate 46.

Slide plate 46 is one element of a slide assembly which includes a horizontally extending T-shaped slide guide 56 fixedly secured to a laterally outward side of the slide plate 46 by means of bolts 49, 51.

Guide 56 of the clamp die slide assembly is slidably mounted in a complementary T-shaped slot 58 horizontally extending through a laterally inward edge portion of a slide holder 60. Slide holder 60 is a generally rectangular block having a laterally outward extension 62 and mounting in the inward portion thereof a die position adjusting motor 66. Motor 66 includes a horizontally extending cylinder 68 fixedly carried in a horizontal bore extending into the slide holder 60. Slidably mounted within the cylinder 68 is a piston 70 fixed to a piston rod 72 to define at one end of the cylinder a pressure chamber 74 that receives pressurized hydraulic fluid via a conduit in the form of a nipple 78. Nipple 78 is supported upon a supply bracket 80 (FIG. 2) fixed to an end of the slide holder extension 62. The nipple 78 is alternatively connected to a source of hydraulic pressure 79 or a sump (or pressure return) 81 by means of a valve 83.

Figure 5:
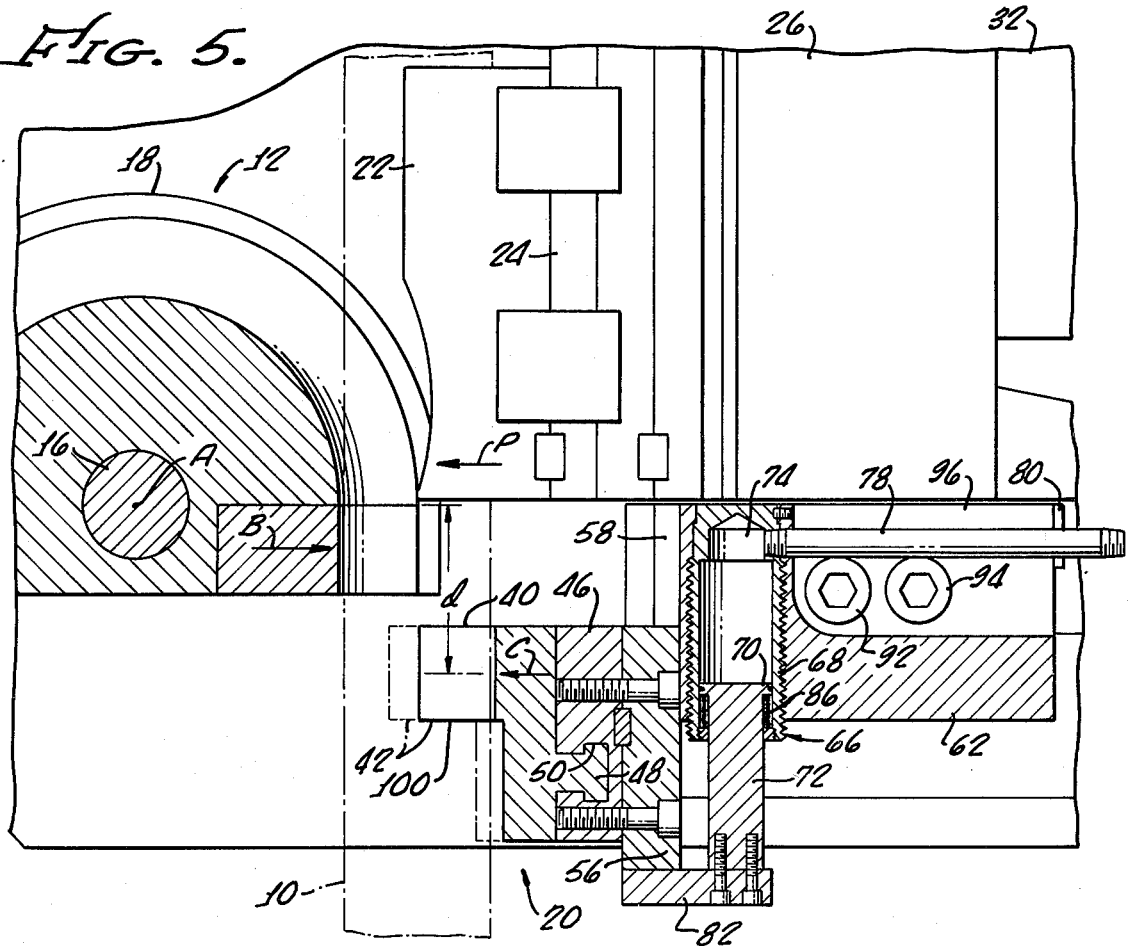
FIG. 5 is a sectional view similar to FIG. 4 showing the die in tangentially extended position.

A slide drive arm 82 has one end bolted to an end of the motor piston rod 72 and the other end fixed (as by welding, for example) to a forward end of the slide assembly guide 56, whereby upon pressurization of the chamber 74 by supplying hydraulic fluid from pressure source 79 to the motor chamber 74, piston rod 72 is driven forwardly carrying the slide assembly 46, 56 forwardly therewith to the position illustrated in FIG. 5.

Figure 4:
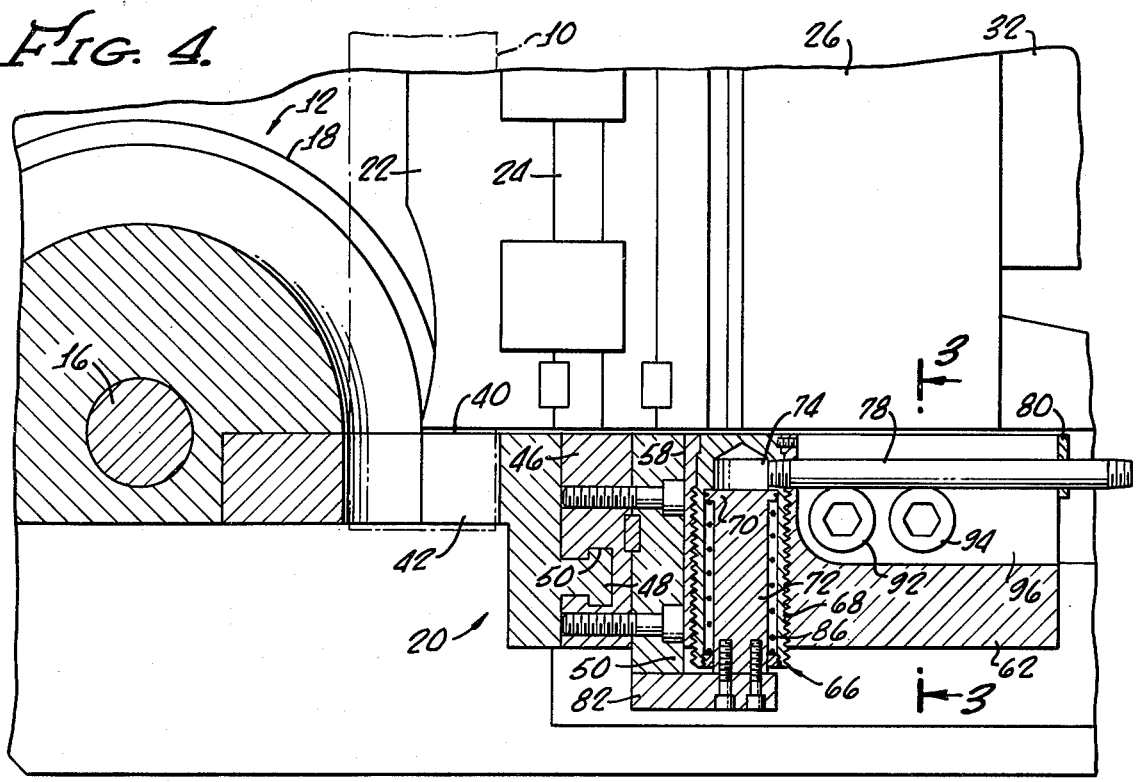
FIG. 4 is a section taken on lines 4—4 of FIG. 1, showing the die in tangentially retracted position.

Upon relief of the pressure in chamber 74, by connecting the supply nipple 78 to sump or pressure return 81, a compression spring 86 which circumscribes the piston rod 72 and is captured within the cylinder between the forward end of the cylinder 68 and the piston 70, will retract the slide assembly and clamp die, driving these rearwardly to the position illustrated in FIG. 4.

Figure 3:
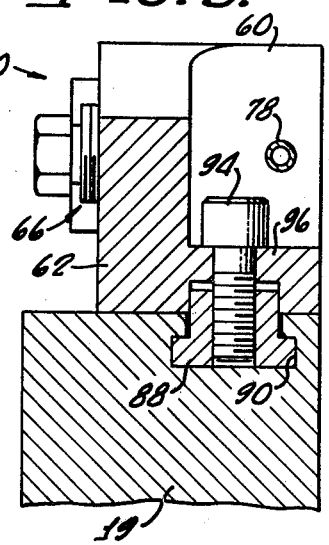
FIG. 3 is a sectional view showing the mode of attachment of the die assembly to the bend arm slide.

Slide holder 60 is adjustably mounted to the swinging bend arm 14 by means of a slide holder locking T 88 that is slidably captured in a T-shaped guideway 90 formed in the upper surface of swinging bend arm slide 19. Bolts 92, 94 extend through a horizontally extending leg 96 of extension 62 of slide holder 60 into the locking T 88 (see FIG. 3) to draw the slide holder down upon the bend arm slide and lock it in position. Loosening of the bolts 92, 94 allows the bend arm slide and the entire clamp die assembly to be adjusted radially of the bend die as may be required for accommodation of pipe to be bent on different radii. For such pipe of different radii, of course, the dies are changed to a bend die having a pipe receiving cavity of commensurate size.

It will be seen that the described adjustable clamp die is mounted for motion radially of the bend die to and from a clamping position to clamp a pipe against the bend die. It is also mounted for motion between tangentially retracted and tangentially extended positions, permitting adjustment of the clamp die position along a line parallel to a tangent to the bend die, such line being transverse to both the line of radial motion of the clamp die in its clamping action against the bend die and transverse to the bend axis itself.

Preferably, the clamp die is employed in the tangentially extended position illustrated in FIG. 5. Upon actuation of valve 83 to provide pressure from source 79 to the motor chamber 74, the clamp die is moved to the extended position of FIG. 5. In this position the die may be moved substantially radially of the bend die to and from clamping position by operation of the clamp die cylinder 36 to drive the bend arm slide and the clamp die assembly toward and away from the bend die in a generally radial direction. In the tangentially extended position of FIG. 5, the clamp die is urged radially (parallel to a radius) of the bend die by the clamp die cylinder 36 and thus exerts a clamping force upon the pipe along a line indicated by the arrow C. This arrow represents a vector of the force exerted by the clamp die and is translationally resisted by a force represented by arrow B exerted by the bend die upon the interposed pipe 10. In the clamp die position of FIG. 5, the clamp die force C has a moment arm d about the bend axis A which is equal to the distance between the line of the clamp die force and the bend axis. This moment is resisted by an oppositely directed moment created by the force, represented by arrow P, exerted by the pressure die upon a rearward section of the pipe, and by any moment that may be exerted by the bend die force B.

If the clamp die is tangentially retracted, moved to the rear along the length of the pipe 10 (toward the pressure die), the moment arm d decreases and therefore the bending moment of any force exerted by the clamp die also decreases. Conversely, the further forwardly the clamp die is positioned, the less force need be exerted by the clamp die upon the pipe to create a given bending moment. With less force required to be exerted by the clamp die, less scarring or deforming of the pipe will occur.

However, if the distance between the bend to be made and the previously made bend of the multiple bend pipe is less than the distance between the bend axis and the forward edge 100 of the clamp die, the latter cannot be employed in the position illustrated in FIG. 5 (where it is at its position of maximum forward tangential adjustment) since the previous bend in the pipe will cause a portion 10*a* (FIG. 1) of the pipe to be angled away from alignment with the clamp die cavity. Therefore, the cavity of the tangentially extended clamp die could not properly seat upon this angled portion of the pipe. Thus, where the previous bend is close to the bend to be made and the pipe has a configuration, for example, such as is shown in FIG. 1, the clamp die is rearwardly retracted to the position of FIG. 4. This is achieved by actuation of valve 83 to connect pressure return 81 to the chamber 74, releasing the high pressure within the cylinder and allowing the return spring 86 to drive the piston rod, the slide assembly and the clamp die to the rear. Now the apparatus can operate to make a bend in a pipe at a position that is spaced from a prior bend no further than the relatively short length of the clamp die 42.

Valve 83 is remotely operated in a conventional fashion by manual or automatic control. Bending machines are frequently partially or completely automated and all operations on a single length of pipe, in which a number of bends are to be made, may be set into a digital program so that a complete set of bends is accomplished under digital control. In such an application, a given pipe may have both long and short straights between bends so that the clamp die would be controlled (by actuation of valve 83) by the machine controlling digital program to tangentially extend or retract, prior to making a specific bend, according to the predetermined lengths of respective straights.

Although the described embodiment provides but two clearly defined tangential positions of adjustment for the clamp die, namely fully tangentially retracted or fully extended, it will be readily appreciated that the apparatus may be modified to provide one or more intermediate positions of adjustment if deemed necessary or desirable.

In the illustrated arrangement, the clamping stroke of the clamp die, namely the distance travelled between radially retracted position and radially extended positions as the clamp die moves to and from clamping position under control of the clamp die cylinder 36, is a fixed distance. It is contemplated that this distance be selectively variable so that a relatively longer distance of extension toward clamping position be provided when the clamp die is tangentially extended. When the clamp die is tangentially extended as in FIG. 5, the radial stroke of the clamp die toward clamp position under control of clamp die cylinder 36, could be slightly lengthened so that as the clamp die (when tangentially extended) moves radially into its clamping position an initial bending of the pipe will be achieved.

A similar initial bending of the pipe as the tangentially extended clamp die moves into clamping position can be accomplished by employing a fixed radial stroke of the clamping assembly into clamping position, but mounting the clamp die for forward and rearward adjustment along a path that angles inwardly toward the axis of the pipe to be bent. For example, as the clamp die moves from the rearwardly retracted position of FIG. 4 to a forward position comparable to the forwardly extended position of FIG. 5, it would move further toward the left as viewed in these illustrations, and thus would attain a position as indicated by the dotted lines of FIG. 5. In such an arrangement, the pressure die is moved to operative pipe engaging position before the clamp die is moved radially to its pipe clamping and initial bending position.

The clamp die may be additionally mounted for limited pivotal motion about a horizontal or vertical axis to improve the engagement of the clamp die cavity with the pipe when the clamp die is in tangentially retracted position. Thus, additional adjustable mounting of the clamp die may be provided as disclosed in a co-pending application of Homer L. Eaton for Floating Clamp Die, Ser. No. 741,689, filed Nov. 15, 1976. In this arrangement the clamp die is additionally mounted to accommodate angled forward portions of the pipe and thus is self-adjusting in a vertical direction and limited pivotal directions about a horizontal axis normal to the axis of the pipe. The disclosure of the co-pending application Ser. No. 741,689 is fully incorporated herein by this reference.

The foregoing detailed description is to be clearly understood as given by way of illustration and example only, the spirit and scope of this invention being limited solely by the appended claims.

We claim:

1. A rotary bending machine comprising, a support a swinging bend arm assembly mounted on said support for rotation about a bend axis, said swinging bend arm assembly including a bend die having a fixed member adapted to engage a pipe pressed by a clamp die, a bend arm slide mounted for motion substantially radially of said bend die, a slide holder secured to said bend arm slide, a clamp slide carrying a clamp die and mounted to said slide holder for tangential motion parallel to a tangent to said bend die, said clamp slide being mounted for cooperation with and for said tangential motion relative to said fixed bend die member between a first position in which the clamp die is directly opposed to said fixed bend die member, so as to press a pipe directly against said fixed bend die member, and a second position in which the clamp die is shifted forwardly of said bend die fixed member, forwardly of said bend arm slide, and forwardly of a pipe positioned at said bend die, so as to press a pipe against said fixed member and exert a force thereon having an increased moment arm about said bend axis, said clamp die being movable along a pipe positioned against said fixed bend die member either forwardly toward or rearwardly from a previously made bend in the pipe according to the relation between the length of said clamp die and the distance between bends, means for rotating said swinging bend arm assembly, and a pressure die for pressing against a pipe to be bent.

2. The apparatus of claim 1 including means for driving said clamp die slide in said tangential motion, said means for driving comprising a motor mounted in said slide holder and having an extensible driving element, and a slide drive arm connected in driving relation to and between said drive element and said clamp slide.

3. The apparatus of claim 2 wherein said motor includes an hydraulic cylinder, a piston and piston rod mounted in said cylinder, and spring means in said cylinder for driving said piston toward one end of said cylinder, said slide drive arm being connected to said piston rod and to said slide.

4. The method of bending a pipe to produce a number of bends therein that are mutually spaced by different distances, comprising the steps of positioning one part of a pipe tangentially against a rotary bend die, laterally restraining a rear portion of the pipe, moving a clamp die toward said bend die to press said pipe against the bend die at one of two clamp die locations along said pipe, the first of said locations being directly opposite said bend die to cause the clamp die to contact the pipe substantially at the point of tangency of the pipe and bend die so as to exert a force on the pipe having a relatively small moment arm, the second of said locations being displaced forwardly of said pipe and forwardly of said bend die to cause the clamp die to contact the pipe at a point forwardly displaced from said bend die so as to exert a force on the pipe having a relatively large moment arm, rotating said bent and clamp dies to make a first bend in said pipe, retracting the clamp die, shifting the pipe forwardly to position another part of said pipe at said bend die, laterally restraining a rear portion of said pipe, shifting the clamp die along the pipe to the other of said two clamp die locations, moving the clamp die toward the pipe to press it against the pipe at said other location, and rotating said bend and clamp dies to make a second bend in said pipe spaced from said first bend.

5. The method of claim 4 wherein said second step of moving said clamp die toward said pipe is carried out with the clamp die in said first location when said second bend is not spaced from said first bend by a distance substantially the same as the length of the clamp die, and wherein said second step of moving said clamp die toward said pipe is carried out with the clamp die in said second location when said second bend is spaced from said first bend by a distance greater than the length of said clamp die.

* * * * *